United States Patent [19]

Lowe

[11] 3,944,472

[45] Mar. 16, 1976

[54] COKE OVEN LID PUSHER

[75] Inventor: Earl F. Lowe, Hendersonville, N.C.

[73] Assignee: Interlake, Inc., Chicago, Ill.

[22] Filed: Apr. 15, 1974

[21] Appl. No.: 460,732

[52] U.S. Cl. ..... 202/262; 202/244; 202/242; 202/245; 202/251; 214/18 PH; 214/35 R; 212/4; 48/124

[51] Int. Cl.[2] ..... C10B 31/02; B66C 13/00

[58] Field of Search ..... 202/262, 244, 242, 245, 202/251; 214/18 PH, 35 R; 212/4; 48/124; 110/173; 193/38, 41

[56] References Cited

UNITED STATES PATENTS

| | | | |
|---|---|---|---|
| 3,142,391 | 7/1964 | Tweit | 202/262 X |
| 3,440,145 | 4/1969 | Tucker, Jr. et al. | 202/262 |
| 3,622,019 | 11/1971 | Lorrek | 214/35 R |
| 3,753,502 | 8/1973 | Abendroth | 202/251 X |

*Primary Examiner*—James H. Tayman, Jr.
*Attorney, Agent, or Firm*—Prangley, Dithmar, Vogel, Sandler & Stotland

[57] ABSTRACT

A device for positioning a lid for a coke oven charging port in the charging port. An arm is pivotally mounted on a coal hopper and carries a pusher member shiftably mounted on the bottom thereof. A motor also mounted on the coal hopper is connected to the arm and moves the arm and the pusher member between a storage position wherein the arm and the pusher member are spaced away from the coke oven and a use position wherein the pusher member is on the coke oven and is moved toward the associated charging port to push the lid toward and into the charging port.

15 Claims, 6 Drawing Figures

COKE OVEN LID PUSHER

BACKGROUND OF THE INVENTION

The coking of coal is important to the steel making industry but involves a process which generates many pollutants hazardous to health. One of the most polluting operations in the coking of coal is the loading of coal into the coke ovens. Generally, the loading of coal is performed by transferring coal from hoppers located on a larry car adapted to ride on top of the coke ovens into the coke oven to be charged.

Many devices have been innovated to reduce the amount of pollutants emitted from the coke ovens during the charging of coal, such as sleeves on the hopper discharge tubes which are movable into the charging ports to effect a seal between the hopper and the coke oven to prevent effluents from being emitted from the coke oven through the charging ports. However, when the sleeves are raised, the lids to the charging ports which have been previously removed to allow the coal to be introduced into the coke oven must be replaced. Between the time that the sleeves are raised and the lids are positioned in place, effluents in the form of coal dust and the like can be and usually is emitted from the coke oven.

SUMMARY OF THE INVENTION

This invention relates to a coke oven lid pusher for mechanically moving a lid spaced away from the charging port of a coke oven rapidly into the charging port. More particularly, this invention relates to a device which includes a pusher member shiftably mounted for movement between a use position thereof and a storage position thereof.

A principal object of the invention is to provide a mechanical device for rapidly moving a lid for a charging port toward and into the charging port to prevent excessive emission of pollutants from a coke oven.

An important object of the present invention is to provide a device for positioning a lid for a coke oven charging port in the charging port subsequent to charging the coke oven with coal from a hopper, the device comprising a pusher mechanism connected to the hopper, for urging the lid from a position away from the charging port toward and into the charging port, and a motor connected to the pusher mechanism for moving the pusher mechanism between a storage position thereof wherein the pusher mechanism is spaced away from the coke oven to facilitate movement of the coal hopper and a use position thereof wherein said pusher mechanism is in position to contact the lid to urge the lid toward and into the charging port, continued operation of the motor when the pusher mechanism is in the use position thereof causing movement of the pusher mechanism and the lid in contact therewith toward the charging port until the lid is in position in the charging port, whereby a charging port lid removed from the charging port during charging of the coke oven with coal is rapidly positioned in the charging port by activation of the motor to move the pusher mechanism from the storage position thereof to the use position thereof.

Another object of the present invention is to provide a device of the type set forth wherein an arm is connected to the coal hopper for movement between the storage position thereof and the use position thereof and a pusher member is shiftably mounted on the arm and extends outwardly therefrom and is movable with the arm between the storage position thereof and the use position thereof.

A further object of the present invention is to provide a device of the type set forth wherein means is provided for maintaining the pusher member at an angle of about 90° to the arm during movement of the arm and the pusher member between the storage positions thereof and the use positions thereof.

These and other objects of the present invention may be more readily understood by reference to the following specification and drawings in which:

DESCRIPTION OF THE PREFERRED EMBODIMENT

Figure 1:
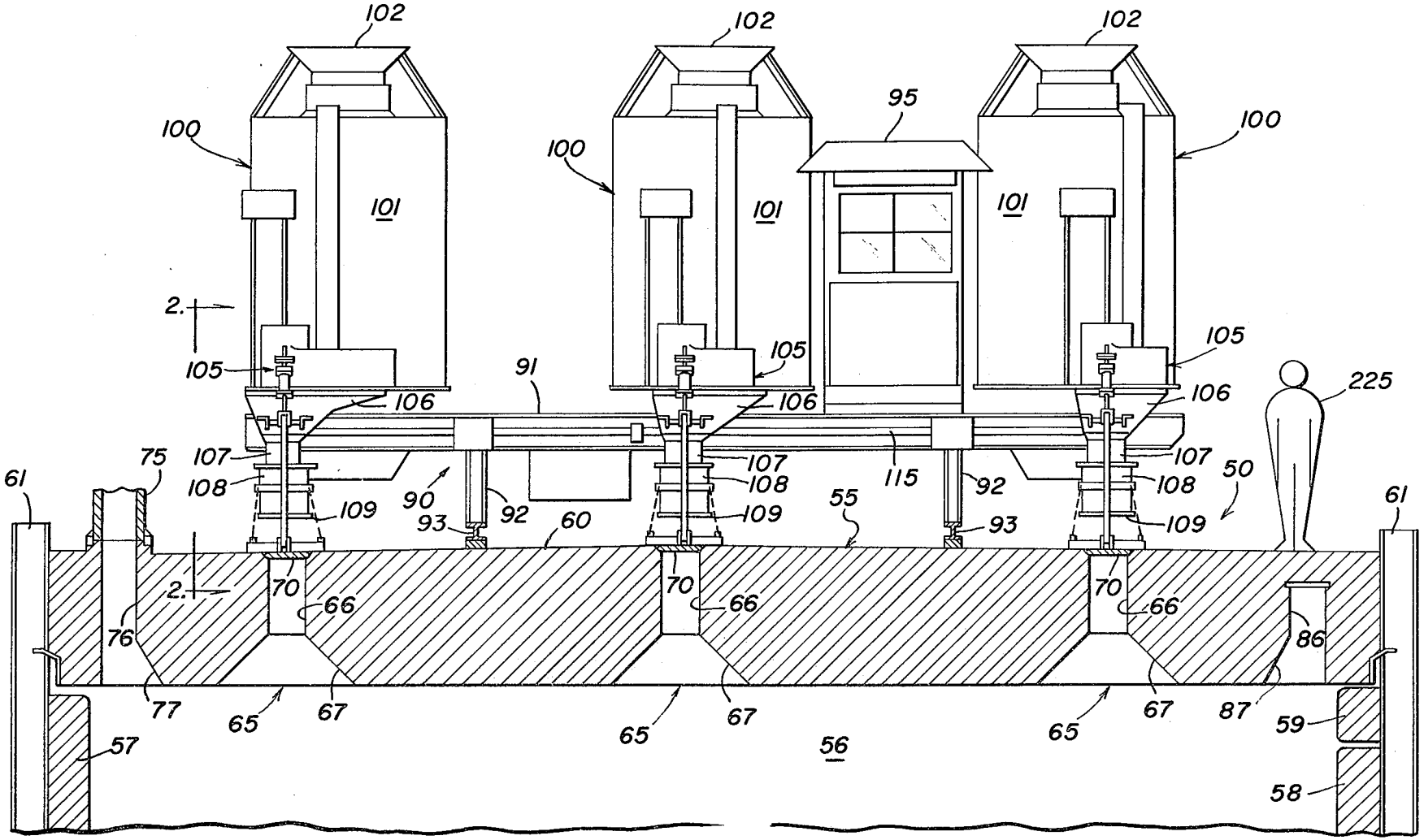
FIG. 1 is an end elevational view partly in section of a larry car having coal hoppers mounted thereon in registry with the charging ports of a coke oven and showing the relative size of the equipment to a human figure.

Referring now to the drawings, there is disclosed a bank of coke ovens 50 which includes a plurality of individual coke ovens 55, each of the coke ovens having an oven chamber 56. Each of the coke ovens 55 is provided with a coke side door 57 at one end of the coke oven and a pusher side door 58 at the other end of the coke oven, a chuck door 59 being positioned above the pusher side door. An oven top 60 is common to each of the individual coke ovens 55 in the bank of coke ovens 50. Buch stays 61 are positioned intermediate each of the individual coke ovens 55 to provide support structure for the above mentioned doors and ovens.

Each of the coke ovens 55 is provided with a plurality of charging ports 65, three being shown for each coke oven. Each of the charging ports 65 has a cylindrical portion 66 extending vertically from the top 60 of the individual coke oven 55 and a conical portion 67 intersecting the cylindrical portion 66 and opening into the oven chamber 56. Each of the charging ports 65 is provided with an outwardly extending flared lip 68 for receiving the associated charging port lid 70 therein. Each of the lids 70 has a flat bottom surface 71 and a convex upper surface 72. Finally, each of the coke ovens 55 is provided with a stand pipe 75 providing communication between a collector main (not shown) and the coke oven chamber 56 via a cylindrical opening 76 having a flared bottom end 77. On the pusher side of the coke oven 55, there is an opening 86 having a flared end 87 which may be used for U-tubes to connect adjacent coke ovens or may be used to connect the coke oven chamber 56 with an additional collector main.

A larry car 90 includes a flat platform 91 having railway wheels 92 mounted thereon to facilitate movement of the larry car along spaced apart rails 93 extending the length of the bank of coke ovens 50. The larry car 90 is provided with a control cab 95 in which an attendant rides to control movement of the larry car and the mechanism mounted thereon, as hereinafter described. The larry car 90 supports a plurality of coal hoppers 100, the coal hoppers corresponding in number to the number of charging ports 65 in each of the individual coke ovens 55. As shown, there are three coal hoppers 100, each being identical in construction, and, therefore, only one such coal hopper will be described in detail for the sake of brevity.

Figure 2:
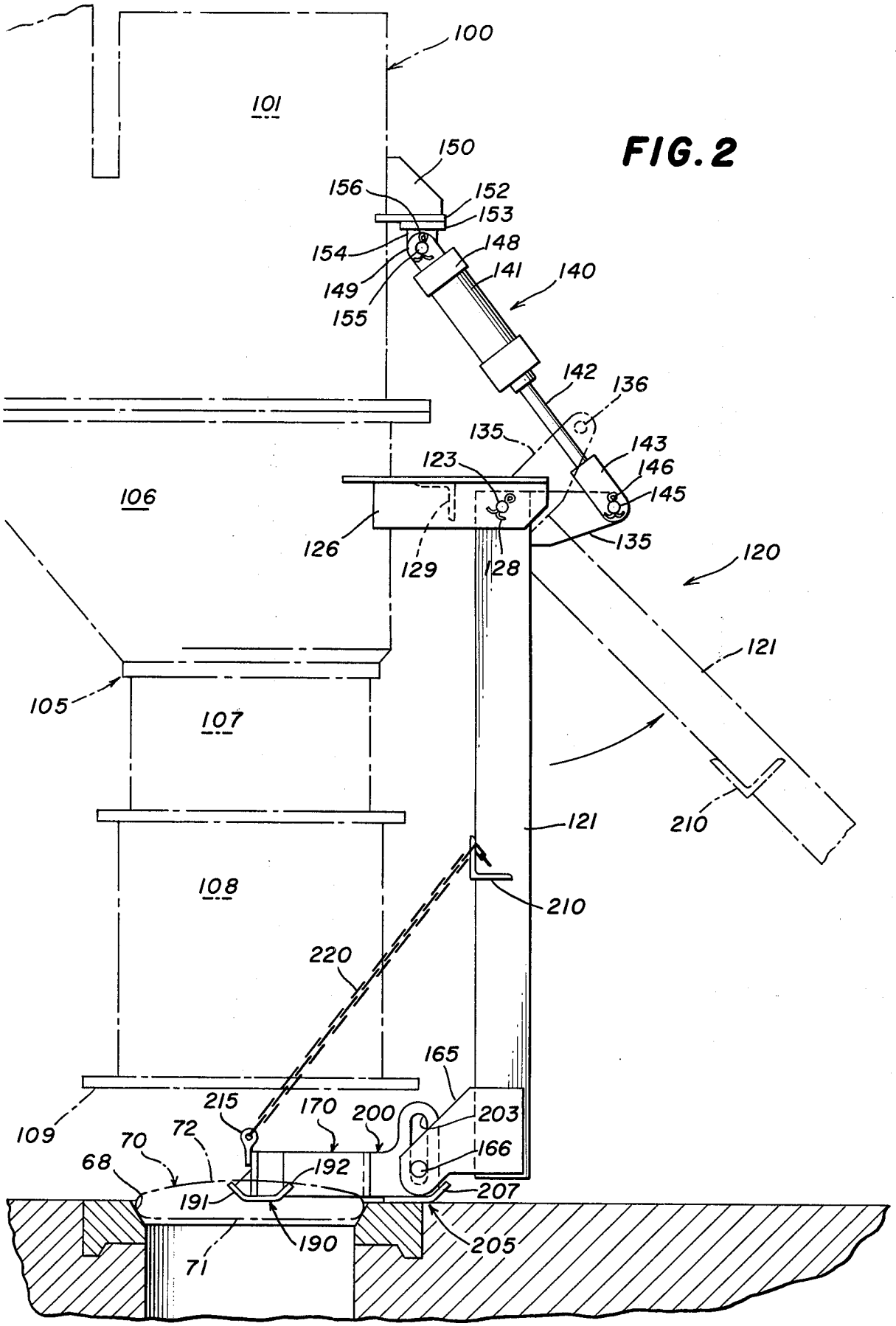
FIG. 2 is an enlarged side elevational view of the discharge tube of a coal hopper having the inventive device mounted thereon with the pusher member in contact with a lid positioned in a charging port.
Figure 3:
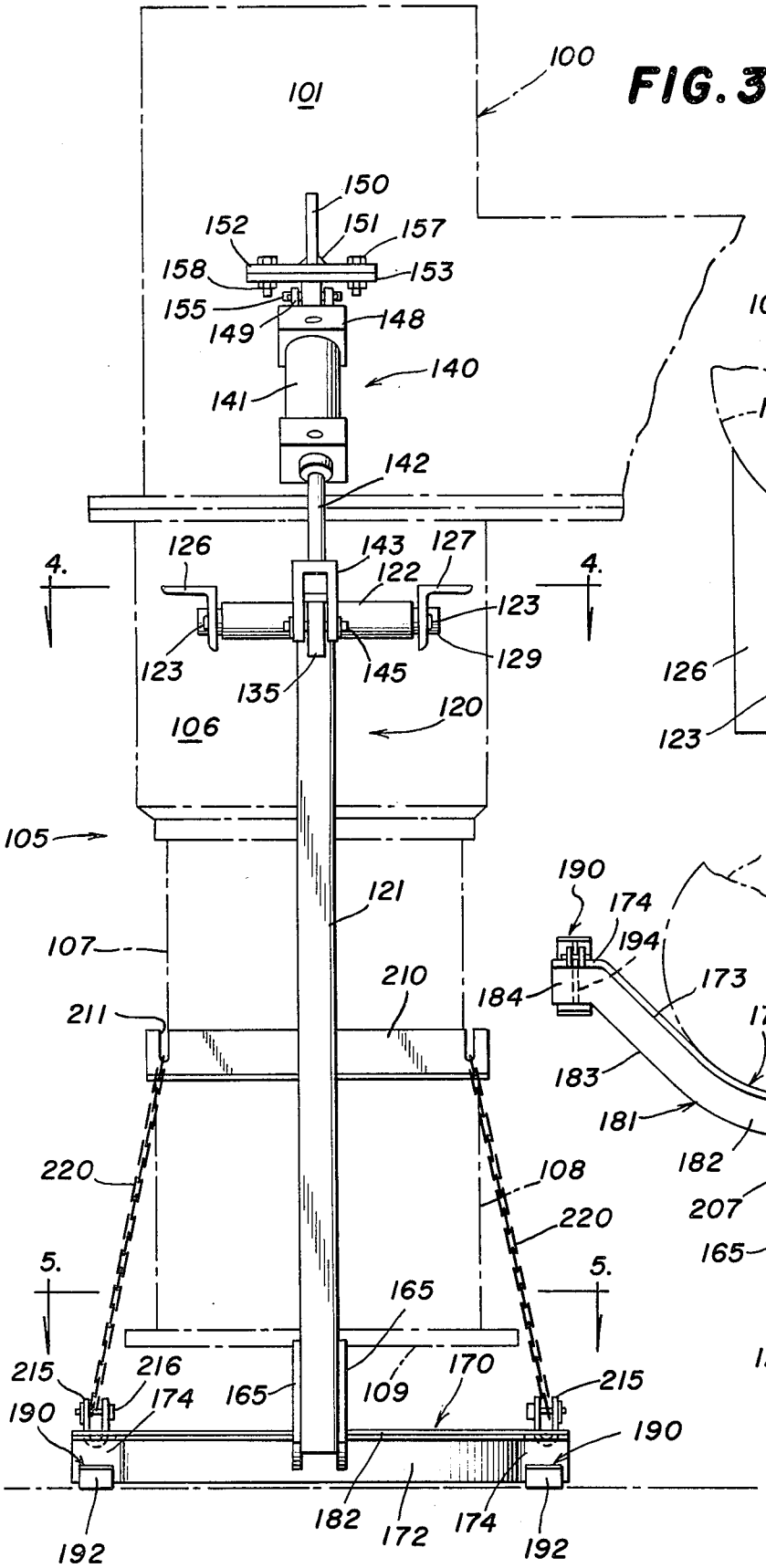
FIG. 3 is an end elevational view of the coal hopper and inventive device shown in FIG. 2.
Figure 4:
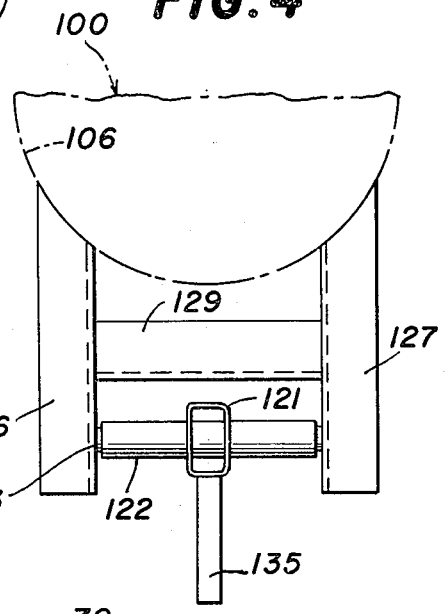
FIG. 4 is an elevational view of the device shown in FIG. 3, as seen along the lines 4—4 thereof.
Figure 5:
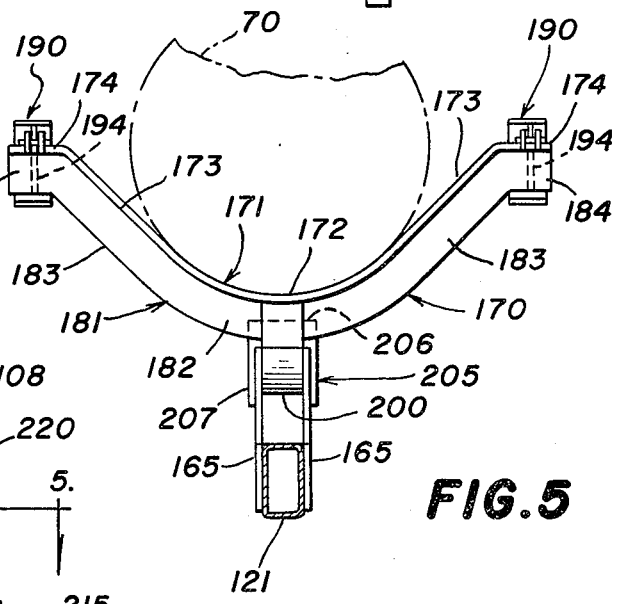
FIG. 5 is an elevational view partly in section of the device illustrated in FIG. 3 as seen along the lines 5—5 thereof.

Each of the hoppers 100 has a cylindrical wall 101 forming the main body of the hopper and an inlet 102 at the top thereof in the shape of a funnel which may be provided with a cover (not shown). The coal hopper 100 has a discharge mechanism 105 at the bottom thereof which as seen in FIG. 2 of the drawings includes a funnel box 106 connected at one end to the cylindrical wall 101 and at the other end to a discharge tube 107. A sleeve 108 is slidably mounted on the tube 107 and is adapted to move to a storage position, as shown in FIG. 2, wherein the bottom flange 109 of the sleeve is spaced away from the top of the coke oven 60 and a use position, as shown in FIG. 1, wherein the sleeve 108 is extended downwardly so that the flange 109 surrounds the associated charging port 65 and forms a seal with the top 60 of the coke oven. Finally, the larry car 90 has a mechanism 115 thereon for providing communication between the discharge mechanisms 105 and the central storage area of the respective hoppers 100 and also may be effective to raise and lower the sleeves 108, as hereinbefore set forth.

Each of the coal hoppers 100 is provided with a pusher mechanism 120 to move a lid 70 from a position away from the associated charging port 65 toward and into the charging port in order to prevent excessive emissions of effluents containing coal dust and the like through the charging port subsequent to the movement of the sleeve 108 to the storage position thereof. The pusher mechanism 120 includes an elongated arm 121 which is hollow and rectangular in cross section. The arm 121 is mounted on a shaft 122 having stub axles 123 extending outwardly therefrom. The stub axles 123 extend through an opening in two spaced apart angle irons 126 and 127 which are fixedly mounted on the funnel box 106 of the hopper 100 and extend outwardly therefrom. The shaft 122 is maintained in place by two cotter pins 128 extending through respective ones of the shafts 123. A support angle iron 129 is welded or otherwise fixedly connected to the angle irons 126 and 127 intermediate the hopper 100 and the shaft 122.

A lever plate 135 is fixedly connected to the arm 121 and extends outwardly therefrom and has an aperture 136 therein (FIG. 2). A motor 140 includes an air cylinder 141 having a piston 142 extending outwardly therefrom. A clevis 143 is carried by the distal end of the piston 142 and has aligned apertures in each of the arms thereof. A shaft 145 extends through the opening 136 in the lever plate 135 and through the arms of the clevis 143, the shaft being maintained in place by two cotter pins 146. The motor 140 has a block 148 on the end thereof away from the piston 142 and spaced apart mounting tabs 149 extending outwardly of the block 148. A mounting plate 150 is fixedly mounted as by welds 151 to the cylindrical wall 101 of the associated hopper 100. The plate 150 carries thereon a flange 152 positioned horizontally. A flange 153 has a mounting finger 154 extending downwardly therefrom, the flange 153 being connected to the flange 152 by means of a plurality of bolts 157 and nuts 158. The motor 140 is mounted on the hopper 100 by means of a shaft 155 which extends through the spaced apart mounting tabs 149 on the upper block 148 of the motor, the shaft 155 extending through an aperture in the finger 154 and being maintained in place by two cotter pins 156. Accordingly, it is seen that the motor 140 is pivotally mounted on the hopper 100 and pivotally connected to the pusher mechanism 120 and more particularly to the arm 121.

At the bottom end of the arm 121, two plates 165 are fixedly mounted and extend away from the arm 121 toward the associated discharge mechanism 105, each of the plates 165 having a lower end 167 thereof spaced below the lower end of the arm 121. A pin 166 interconnects the plates 165 and is fixedly mounted thereto. A pusher member 170 is shiftably mounted on the arm 121 and includes an upstanding flange 171 having a central arcuate portion 172 with two wing portions 173 extending outwardly of the portion 172. Each of the wing portions 173 is provided at the outer end thereof with an angle portion 174. It is contemplated that the flange 171 may be of one piece or of several pieces welded together. Interconnected to, or integral with, the flange 171 is an outwardly extending flange 181 being provided with corresponding portions to the flange 171. Specifically, the outwardly extending flange 181 is provided with an arcuate central portion 182 having wings 183 extending outwardly therefrom. Each of the wings 183 has an angle portion 184 extending from the end thereof. It should be noted that the corresponding edges of the flange 171 and 181 are parallel.

Two skis 190 are respectively mounted on the outwardly extending portions 174 and 184 of the flanges 171 and 181, each ski being provided with a bottom plate 191. The bottom plate 191 is interconnected, or is integral, with upwardly extending plates 192 to form a ski. A mounting plate 193 mounts the ski 190 on the associated portion of the pusher member 170 and is maintained in place by means of a fastener 194. Each pusher member 170 has a rear mounting bracket 200 with a portion 201 thereof fixedly connected to the central portions 172 and 182 of the flanges 171 and 181, respectively. An elongated member 202 integral with the central member 201 has an elongated slot 203 therein through which passes the pin 166, thereby shiftably to mount the pusher member 170 on the arm 121. The rear mounting bracket 200 has a skid 205 on the bottom thereof, which skid has a bottom plate 206 and an outwardly extending slanted plate 207.

The arm 121 has an angle iron 210 welded thereto intermediate the bottom and the top of the arm. The angle iron 210 has spaced apart slots 211 near the outer ends thereof. Each of the angle portions 174 of the pusher member 170 has a U-clamp 215 fixedly mounted thereon and a chain 220 interconnects the angle bar 210 and more particularly the corresponding slot 211 with the corresponding U-clamp 215 and is maintained in place in the U-clamp by means of a bolt 216. The length of the chains 220 is such that the pusher member 170 remains substantially at an angle of about 90° with respect to the arm 121 during movement of the pusher member 170 and the arm 121 from the storage position thereof, shown in phantom, in FIG. 6, to the use position thereof, shown in full line in FIG. 6. As seen from FIG. 6, a charging port lid 70 positioned away from the associated charging port 65 is moved toward and into the charging port, as denoted by the arrow 230, by movement of the pusher mechanism 120 from the storage position thereof to the use position thereof, as hereinafter will be set forth. Finally, the size of the equipment hereinbefore explained is illustrated by a picture of an attendant 225 standding on the coke oven 55 in FIG. 1 of the drawings.

Operation of the pusher mechanism 120 will now be explained. Since the lever plate 135 is fixedly mounted to the arm 121, the arm 121 is movable between the dotted line position shown in FIG. 2 and 6 which is the storage position thereof and the full line position which is the use position thereof in response to actuation of the motor 140. The motor 140 is pivotally mounted both to the coal hopper 100 and to the arm 121 through the lever plate 135. Accordingly, when the piston 142 of the motor 140 is withdrawn or retracted, the arm 121 is in the storage position thereof wherein both the arm 121 and the pusher member 170 shiftable mounted thereon are spaced away from the top 60 of the bank of coke ovens 50. With the pusher mechanism 120 in the storage position thereof, the larry car 90 is free to move between a source of coal and the particular coke oven 55 to be charged with coal. This, of course, assumes that the sleeve 108 of each of the discharge mechanisms 105 are retracted or raised, thereby to facilitate movement of the larry car 90 along the railroad tracks 93.

After the coal hoppers 100 have each obtained a full load of coal from the source thereof and the larry car 90 has moved to the coke oven 55 to be charged with coal so that each of the discharge mechanisms 105 is in registry with the corresponding one of the charging ports 65, the lids 70 are either automatically or manually removed from the charging ports. The sleeve 108 of each of the discharge mechanisms 105 is lowered to contact the top 60 of the coke oven 55 and the mechanism 115 is actuated to permit coal to flow by gravity or by conveyor (not shown) through the discharge mechanism 105 into the associated coke oven 55 and more particularly, into the chamber 56. Necessarily, a large amount of coke dust is generated during the loading of coal into the coke oven 55 and effluents including coke dust and the like are produced and normally would escape to the atmosphere from the coke oven chamber 56. The sealing relation between the sleeves 108 and more particularly the flanges 109 and the top 60 of the coke oven substantially reduces the amount of effluents escaping to the atmosphere. Upon retraction of the sleeves 108 from their sealing relation with the top 60 of the coke oven 55, effluents are once again permitted to escape to the atmosphere. Accordingly, the rapid replacement of the lid 70 which has been placed beside the charging port 65 as shown in FIG. 6, is required to prevent excessive pollution of the atmosphere.

The pusher mechanism 120 is in the storage position thereof when both the arm 121 and the pusher member 170 are spaced away from the top 60 of the coke oven 55 and the piston 142 is retracted. Activation of the motor 140 results in movement of the piston 142 outwardly thereby pivoting the arm 121 from the phantom line position shown in FIG. 6 toward the full line position shown in FIG. 6. After the pusher member 170 has contacted the top 60 of the coke oven 55 and contact has been made between the pusher member 170 and more particularly the arcuate portion 172 of the flange 171 and the lid 70, the pusher mechanism 120 is in the use position thereof. Continued extension of the piston 142 results in continued movement of the pusher mechanism 120 in the direction of the arrow shown in FIG. 6 toward the full line position shown therein. After the initial contact between the pusher member 170 and the lid 70, continued contact is ensured due to the configuration of the pusher member 170. Specifically, the arcuate portion 172 of the flange 171 in cooperation with the two wing portions 173 ensure that the lid 70 is maintained centrally of the pusher member 170 during movement of the lid from a position away from the associated charging port 65 toward and into the charging port as shown by the arrow 230.

Movement of the pusher mechanism 120 from the storage position thereof to the use position thereof and the continued movement of the pusher mechanism required to position the associated lid 70 into the associated charging port 65 is facilitated by the skis 190 and the skid 205. As hereinbefore set forth, there are two skis 190 and one rearward skid 205 provided for the pusher mechanism 120 to ensure that the pusher member 170 does not jamb into the top 60 of the coke oven 55. The shiftable mounting of the pusher member 170 on the arm 121 in cooperation with the skis 190 and the skid 205 ensures that the pusher member 170 contacts the top 60 to the coke oven 55 at the proper angle and thereafter remains in contact with the top of the coke oven and slides therealong toward the associated charging port 65. The restraining members or chains 220 maintain the pusher member 170 at an angle of approximately 90° with respect to the arm 121 when the pusher mechanism 120 is in the storage position thereof, thereby preventing the pusher member 170 from dragging on the top 60 of the coke oven 55 or from becoming misaligned to prevent movement to the use position thereof.

Figure 6:
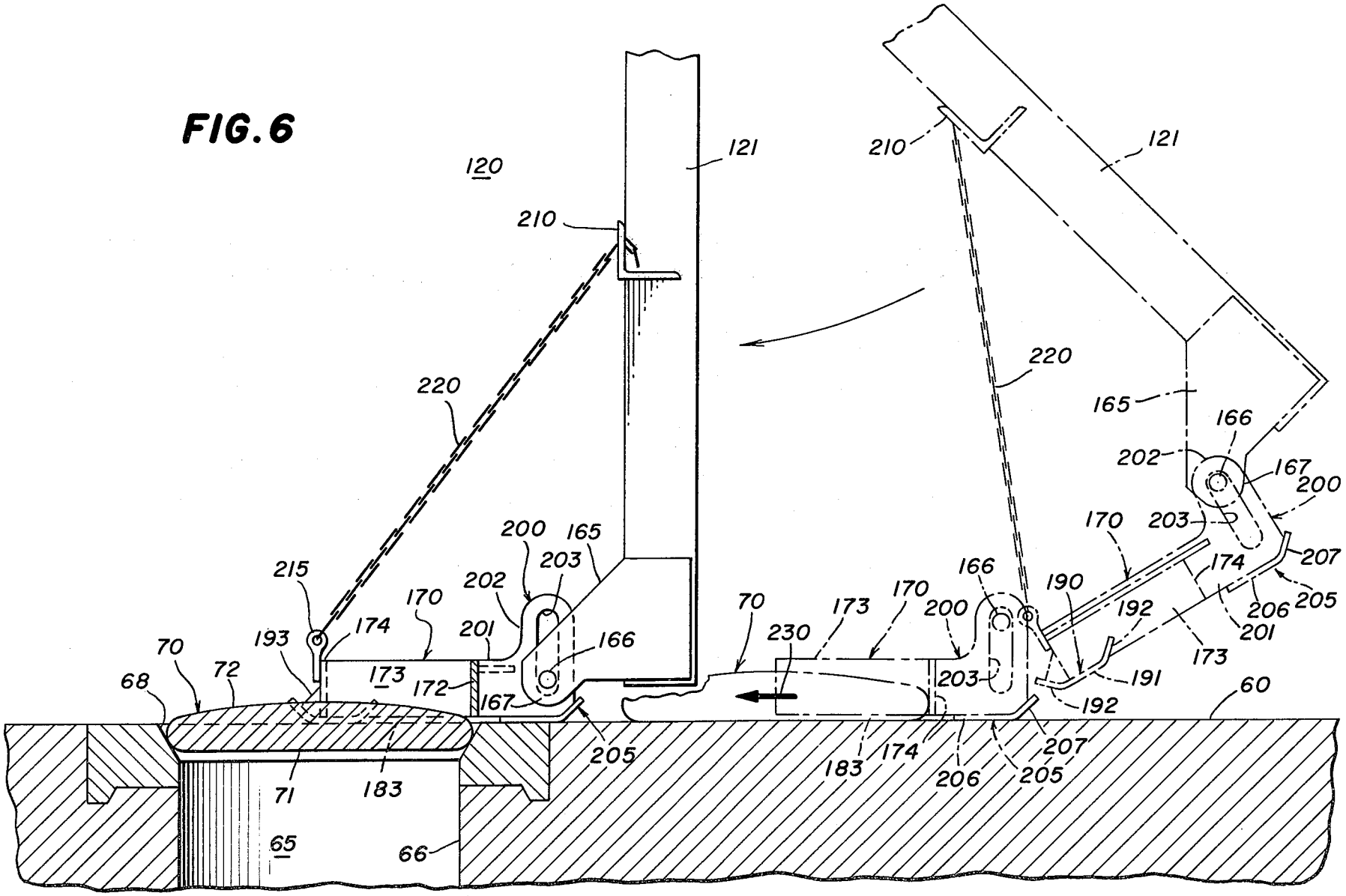
FIG. 6 is an elevational view of the pusher member and arm of the inventive device showing in the storage position thereof, shown in phantom, and the use position thereof, wherein the lid is moved from a position away from the charging port toward and into the charging port.

After the initial contact has been made between the pusher member 170 and the lid 70, as shown in the central portion of FIG. 6, continued extension of the piston 142 moves the pusher mechanism 120 to the full line position thereof as seen in FIG. 6, wherein the lid 70 is sealably disposed within the receiving portion 68 of the associated charging port 65. Subsequently, the piston 142 of the motor 140 is retracted to move the lever plate 135 and hence the pusher mechanism 120 to the storage position thereof to facilitate movement of the larry car 90 to the source of coal. The entire procedure can then be repeated to ensure rapid positioning of lids 70 in the charging ports 65 to reduce the amount of effluents vented to the atmosphere.

Although there has been explained above the sequence of operation for only one of the coal hoppers 100 and the pusher mechanism 120 connected thereto, it is understood that three such pusher mechanisms 120 are involved and each work simultaneously to move the lids 70 rapidly into sealing relationship with each of the three charging ports 65 shown in FIG. 1 of the drawings. It is also understood that more than three coal hoppers 100, or less than three coal hoppers may be used without departing from the spirit of the present invention, the number of coal hoppers being immaterial, provided that each coal hopper has associated therewith the appropriate pusher mechanism 120. With the use of the present invention, excessive emissions of pollutants is prevented due to the rapid positioning of the lid 70 in the associated charging port 65, which rapid positioning substantially lessens the time that the charging ports 65 are open to the atmosphere.

While there has been described what is at present considered to be the preferred embodiment of the present invention, it will be understood that various modifications and alterations may be made herein without departing from the true spirit and scope of the present invention, and it is intended to cover in the appended claims all such modifications and alterations as fall within the true spirit and scope of the present invention.

What is claimed is:

1. A device for positioning a lid for a coke oven charging port in the charging port subsequent to charging the coke oven with coal from a hopper in registry with the charging port in the coke oven top, said device comprising a pusher mechanism connected to the hopper for urging the lid from a position resting on the coke oven top away from the charging port along the coke oven top toward and into the charging port, and a motor connected to said pusher mechanism for moving said pusher mechanism between a storage position thereof wherein said pusher mechanism is spaced away from the coke oven to facilitate movement of the coal hopper and a use position thereof wherein said pusher mechanism is in contact with the coke oven top and in position to contact the lid to urge the lid toward and into the charging port, continued operation of said motor when said pusher mechanism is in the use position thereof causing sliding movement of said pusher mechanism and the lid in contact therewith toward the charging port until the lid is in position in the charging port, whereby a charging port lid removed from the charging port during charging of the coke oven with coal is rapidly positioned in the charging port by activation of said motor to move said pusher mechanism from the storage position thereof to the use position thereof.

2. The device set forth in claim 1, wherein said pusher mechanism is pivotally mounted with respect to the hopper.

3. The device set forth in claim 1, wherein said pusher mechanism includes means for reducing the friction between said pusher mechanism and the coke oven.

4. The device set forth in claim 1, wherein said pusher mechanism has a portion thereof shaped complementary to the edge of the lid to prevent misalignment of the lid with the associated charging port.

5. The device set forth in claim 1, wherein said motor is pivotally mounted on the associated hopper and pivotally mounted to said pusher mechanism to provide swinging movement of said pusher mechanism between the storage position thereof and the use position thereof.

6. The device set forth in claim 1, wherein said motor is pivotally connected to a lever plate fixedly mounted on said pusher mechanism and extending perpendicularly away therefrom.

7. A device for positioning a lid for a coke oven charging port in the charging port subsequent to charging the coke oven with coal from a hopper in registry with the charging port in the coke oven top, said device comprising an arm connected to the coal hopper for movement between a storage position thereof and a use position thereof, a pusher member shiftably mounted on said arm extending outwardly therefrom and being movable with said arm between the storage port thereof and the use position thereof, and a motor connected to said arm for moving said arm and said pusher member mounted thereon between the storage positions thereof wherein said arm and said pusher member are spaced away from the coke oven to facilitate movement of the coal hopper and the use positions thereof wherein said pusher member rests on the coke oven in position to contact the lid to urge the lid along the coke oven top toward and into the charging port, continued operation of said motor when said arm and said pusher member are in the use positions thereof causing sliding movement of said pusher member and the lid in contact therewith toward the charging port until the lid is in position in the charging port, said shiftable mounting of said pusher member on said arm causing said pusher member to remain in continuous contact with the lid during sliding movement of the lid toward the charging port, whereby a charging port lid removed from the charging port during charging the coke oven with coal is rapidly positioned in the charging port by activation of said motor to move said arm and said pusher member thereon from the storage positions thereof to the use positions thereof.

8. The device set forth in claim 7, wherein said arm is pivotally mounted with respect to the coal hopper for swinging movement between the storage position thereof and the use position thereof.

9. The device set forth in claim 1, wherein said pusher member is shiftably mounted on said arm by means of an elongated opening in said pusher member slidably mounted on a shaft connected to said arm to provide shifting movement of said pusher mechanism with respect to said arm.

10. The device set forth in claim 7, wherein said pusher member has a central portion thereof shaped complementary to the associated lid and has portions extending outwardly of said central portion to maintain contact between said pusher member and the lid during movement thereof toward and into the charging port.

11. The device set forth in claim 7, wherein said pusher member has spaced apart skis mounted thereon to facilitate sliding movement of said pusher member on the associated coke oven.

12. A device for positioning a lid for a coke oven charging port in the charging port subsequent to charging the coke oven with a coal from a hopper in registry with the charging port in the coke oven top, said device comprising an arm connected to the coal hopper for movement between a storage position thereof and a use position thereof, a pusher member shiftably mounted on said arm extending outwardly therefrom and being movable with said arm between the storage port thereof and the use position thereof, a motor connected to said arm for moving said arm and said pusher member mounted thereon between the storage positions thereof wherein said arm and said pusher member are spaced away from the coke oven to facilitate movement of the coal hopper and the use positions thereof wherein said pusher member rests on the coke oven in position to contact the lid to urge the lid toward and into the charging port, and means for maintaining said pusher member at an angle of about 90° to said arm during movement of said arm and said pusher member between the storage positions thereof and the use positions thereof, continued operation of said motor when said arm and said pusher member are in the use positions thereof causing sliding movement of said pusher member and the lid in contact therewith toward the charging port until the lid is in position in the charging port, said shiftable mounting of said pusher member on said arm and said maintaining means causing said pusher member to remain in continuous contact with the lid during sliding movement of the lid toward the charging port, whereby a charging port lid removed from the charging port during charging the coke oven with coal is rapidly positioned in the charging port by activation of said motor to move said arm and said pusher member thereon from the storage positions thereof to the use positions thereof.

13. The device set forth in claim 12, wherein said maintaining means is connected to both of said pusher member and said arm.

14. The device set forth in claim 12, wherein said maintaining means includes spaced apart chains interconnecting said arm and the ends of said pusher member away from the shiftable connection between said pusher member and said arm.

15. A device for positioning a lid for a coke oven charging port in the charging port subsequent to charging the coke oven with coal from a hopper, said device comprising an arm connected to the coal hopper for movement between a storage position thereof and a use position thereof, a pusher member shiftably mounted on said arm extending outwardly therefrom and being movable with said arm between the storage position thereof and the use position thereof, a pair of skis mounted on the bottom of said pusher member at the end thereof away from said arm and a skid mounted on the other end of said pusher member at the bottom thereof, said skis and said skid being constructed and arranged to facilitate sliding of said pusher member with respect to the top of the coke oven during movement of said pusher member between the storage position thereof and the use position thereof, a motor connected to said arm for moving said arm and said pusher member mounted thereon between the storage positions thereof wherein said arm and said pusher member are spaced away from the coke oven to facilitate movement of the coal hopper and the use positions thereof wherein said pusher member rests on the coke oven in position to contact the lid to urge the lid toward and into the charging port, and means for maintaining said pusher member at an angle of about 90° to said arm during movement of said arm and said pusher member between the storage positions thereof and the use positions thereof, continued operation of said motor when said arm and said pusher member are in the use positions thereof causing movement of said pusher member and the lid in contact therewith toward the charging port until the lid is in position in the charging port, said shiftable mounting of said pusher member on said arm and said maintaining means causing said pusher member to remain in continuous contact with the lid during movement of the lid toward the charging port, said skis and said skid facilitating sliding movement of said pusher member on the top of the coke oven during movement of said pusher member in the use position thereof, whereby a charging port lid removed from the charging port during charging the coke oven with coal is rapidly positioned in the charging port by activation of said motor to move said arm and said pusher member thereon from the storage positions thereof to the use positions thereof.

* * * * *